US006623045B2

(12) United States Patent
Würgler

(10) Patent No.: US 6,623,045 B2
(45) Date of Patent: Sep. 23, 2003

(54) FASTENING DEVICE FOR FITTING PARTS

(75) Inventor: Johannes Würgler, Meisterschwanden (CH)

(73) Assignee: KWC AG, Unterkulm (CH)

( * ) Notice: Subject to any disclaimer, the term of this patent is extended or adjusted under 35 U.S.C. 154(b) by 0 days.

(21) Appl. No.: 09/994,749

(22) Filed: Nov. 28, 2001

(65) Prior Publication Data

US 2002/0079699 A1 Jun. 27, 2002

(30) Foreign Application Priority Data

Dec. 21, 2000 (CH) ..... 2497/00

(51) Int. Cl.[7] ..... F16L 41/00

(52) U.S. Cl. ..... 285/201; 285/219; 285/197; 285/133.11

(58) Field of Search ..... 285/197, 133.11, 285/203, 204, 208, 209, 214, 219

(56) References Cited

U.S. PATENT DOCUMENTS

| | | | | |
|---|---|---|---|---|
| 1,207,478 A | * | 12/1916 | Birkigt | 285/201 |
| 5,014,749 A | | 5/1991 | Humpert et al. | |
| 5,515,882 A | | 5/1996 | Hennis | |
| 5,873,387 A | | 2/1999 | Weber et al. | |

FOREIGN PATENT DOCUMENTS

| | | | | |
|---|---|---|---|---|
| EP | 0 386 594 B1 | | 9/1990 | |
| EP | 0 386 594 A1 | | 9/1990 | |
| GB | 2120340 | * | 11/1983 | 285/197 |
| WO | WO-98/13641 | | 4/1998 | |

OTHER PUBLICATIONS

U.S. patent application Ser. No. 09/985,906, Applicant: Lehner, Title: Fastening Element for Fitting Parts, filed Nov. 2001.*

* cited by examiner

*Primary Examiner*—Lynne H. Browne
*Assistant Examiner*—G M Collins
(74) *Attorney, Agent, or Firm*—Oliff & Berridge, PLC

(57) ABSTRACT

The fastening device is intended for two hydraulically communicating fitting parts (1, 33). In order to fasten a lateral fitting part (33) on the end face to an outer wall (8) of a wide fitting part (1) at a predetermined angle, the fastening device comprises a fastening part (11) and a threaded tube (28) capable of being screwed into the latter. The shape of a zone (16) of one end of the fastening part (11) is matched to the outer wall (8) of the fitting part (1) according to this predetermined angle. The fastening part (11) has means (15) in order to be mounted on an orifice (9) of the wide fitting part (1). The threaded tube (28) is provided with an outer fastening means (32) which co-operates with an inner fastening means (35) of the lateral fitting part (33).

9 Claims, 5 Drawing Sheets

A–A

FASTENING DEVICE FOR FITTING PARTS

BACKGROUND OF THE INVENTION

1. Field of Invention

The present invention relates to a fastening device for fitting parts according to the preamble of patent claim 1 and to a fitting according to claim 7.

2. Description of Related Art

Hydraulic appliances are known with a wide fitting part and lateral part formed as one piece. However, it is difficult to surface treat these appliances because of the sharp edges contact line between these parts.

SUMMARY OF THE INVENTION

The object of the invention is to provide a fastening device for fittings or fitting parts which is relatively uncomplicated and makes simple mounting possible.

This object is achieved by means of a fastening device having the features specified in patent claim 1.

Further advantageous embodiments of the invention are specified in the dependent claims.

The invention is explained in more detail below by way of example, with reference to drawings in which:

DETAILED DESCRIPTION OF PREFERRED EMBODIMENTS

Figure 1:
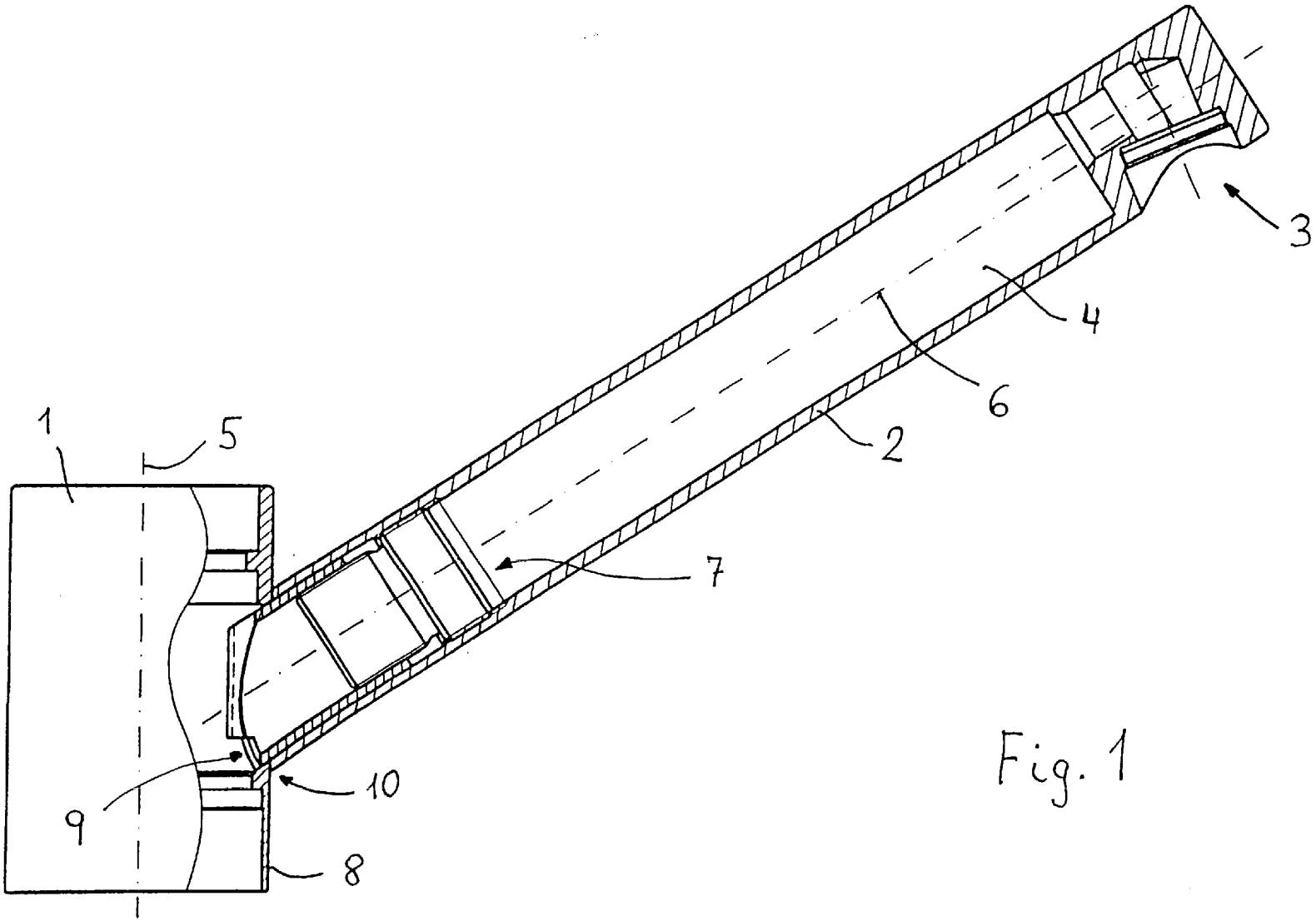
FIG. 1 shows a diagrammatic sectional illustration of two fitting parts which are connected to one another by means of an installed fastening device according to the invention.

FIG. 1 shows two fitting parts 1 and 2 which may be, for example, a housing, a tubular piece, a hydraulic appliance, etc., in particular said figure illustrating preferably a wide fitting part 1 in the form of a housing part of a water fitting, with an at least approximately cylindrical outer contour, and a lateral fitting part 2 in the form of an outflow pipe, with an outflow 3 for water or another liquid. The term "hydraulic" refers, within the meaning of the invention, to any liquid. The outflow pipe 2 has an axial cavity or passage 4 which communicates with an orifice forming the outflow 3. The fitting parts 1 and 2 have in each case axial symmetry or longitudinal axes 5 and 6 located in one and the same plane and are connected to one another in close contact by means of a fastening device 7.

The fitting part 1 has a cylindrical wall 8 which is provided with a continuous orifice 9 for connection to the fitting part 2.

The cylindrical wall 8, the shape of which is not otherwise essentially impaired by the connection to the fitting part 2, is thus in contact with a sectional plane of the fitting part 2 which, for this purpose, is designed in a special form of what is known as a penetration, so that the shape of one end 10 of the fitting part 2 is matched to the outer surface of the cylindrical wall 8 of the fitting part 1 according to an angle W formed by the axes 5 and 6. As a result, the tubular fitting part 2, which has the smaller diameter, can be added, flush, to the fitting part 1 at the predetermined angle W.

Figure 2:
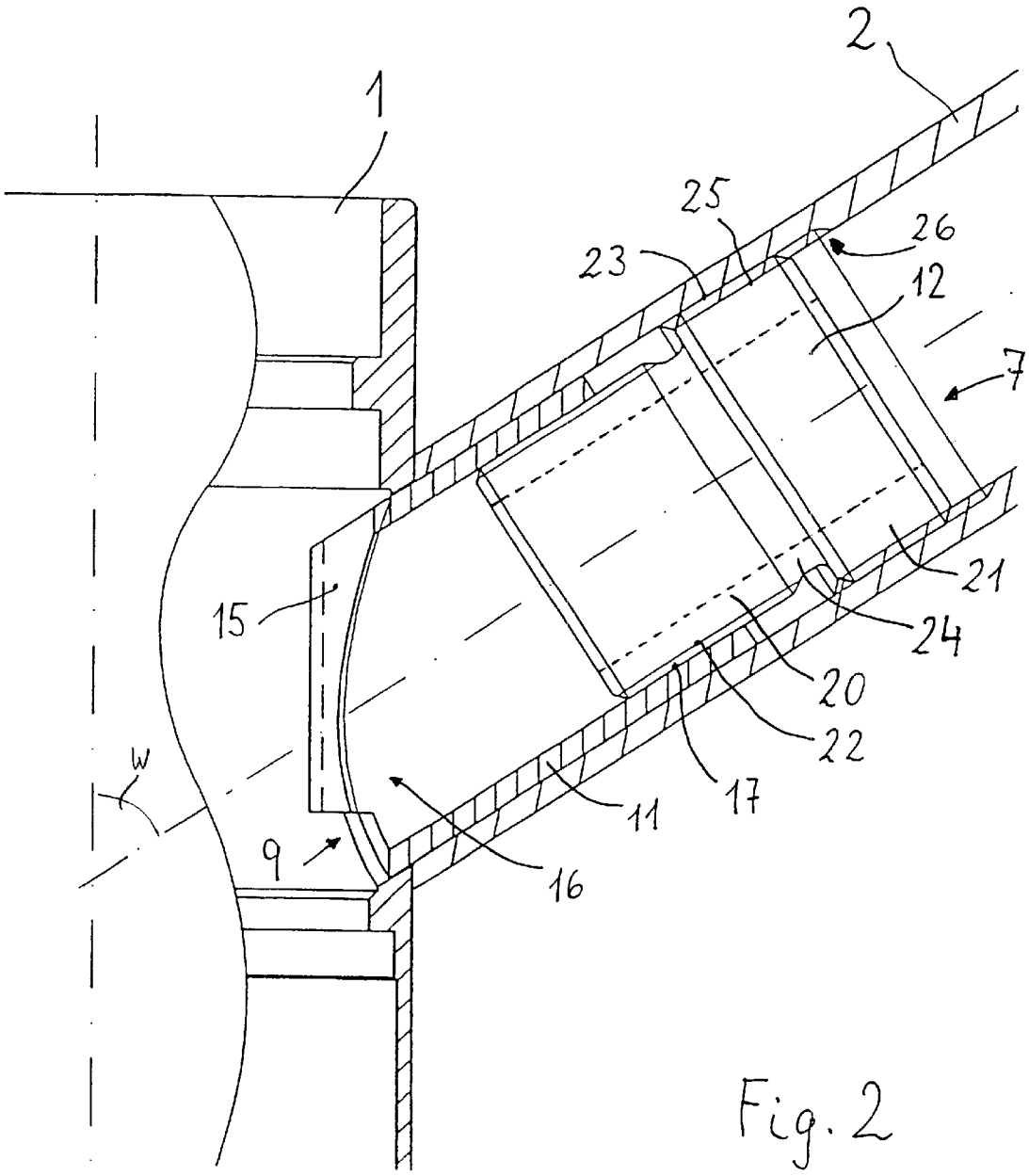
FIG. 2 shows an enlarged partial illustration of such a fastening device.
Figure 4:
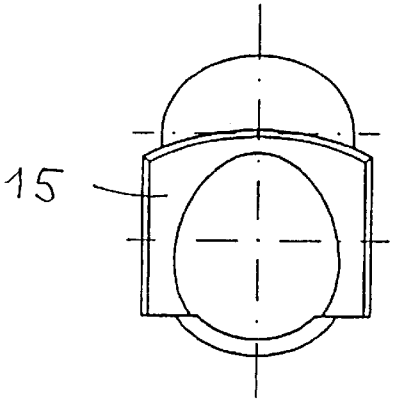
FIG. 4 shows a front side of this fastening part.
Figure 6:
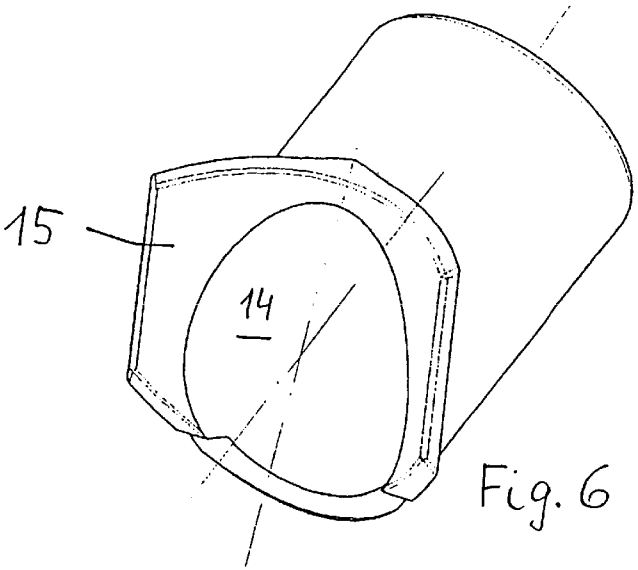
FIG. 6 shows a perspective illustration of this fastening part.
Figure 3:
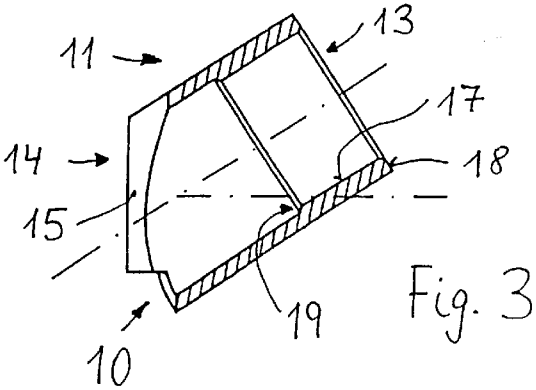
FIG. 3 shows a sectional side view of a fastening part of such a fastening device.
Figure 5:
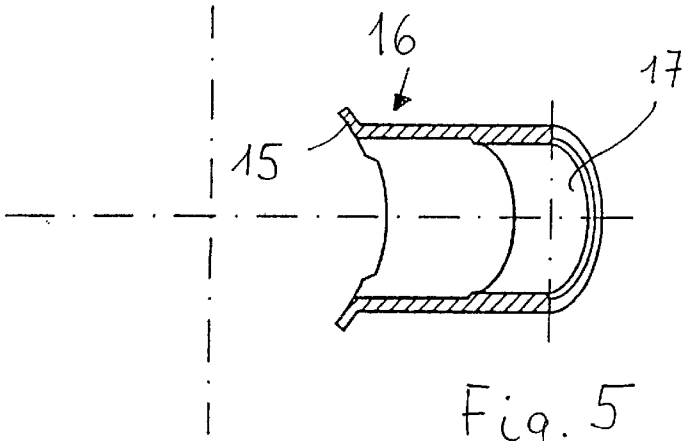
FIG. 5 shows a sectional top view of this fastening part.

The fastening device 7 according to FIGS. 1 and 2, comprises two parts, to be precise a fastening part 11 and a threaded tube 12, both of which are relatively thin-walled. As illustrated in FIGS. 3 to 6, the fastening part 11 may preferably be of tubular design with two orifices 13 and 14. The orifice 14 is located in a front zone 16 having a flange 15. The flange 15 is of cylindrical and/or curved design such that its rear side mates with the cylindrical inner side of the wall 8 of the fitting part 1. A region at the other end of the fastening part 11 has an internal thread 17 between an annular end face 18 and a shoulder 19.

The threaded tube 12 according to FIG. 2 has a portion 20 with a diameter D1 and a portion 21 with a diameter D2 which are provided in each case with an external thread 22 and 23, D2 being somewhat larger than D1. Between the portions 20 and 21 is located a threadless intermediate portion 24, by means of which they are firmly connected. The external thread 22 of the portion 20 has a smaller pitch than the external thread 23 of the portion 21. As may be seen from FIG. 2, the fitting part 2 has an internal thread 25 with a pitch which corresponds to that of the external thread 23. The internal thread 25 extends from an inner shoulder 26 of the fitting part 2 toward the zone 16 of the latter, but over a height which is no greater than about double the height of the portion 21.

The fastening device according to FIGS. 1 to 6 functions as follows:

The fastening part 11, preferably pressed, for example from plastic, and which is also referred to as a molding, is inserted from inside into the orifice 9 of the fitting or housing part 1. By virtue of its shape, the molding 11 then comes to bear fixedly in terms of rotation against the housing part. The threaded tube 12 is screwed, via its external thread 22 with the smaller pitch, into the fastening part 11 up to abutment. The fitting part 2, which is also referred to as an outflow pipe, is subsequently added over the portion 21 of the threaded tube 12 in such a way that the end 10 of said fitting part bears against the housing part 1 in the correct position with respect to the angle W. The threaded tube 12 is then rotated from the housing part 1 by means of a flexible shaft, so that its thread 23 provided with the greater pitch comes into engagement with the internal thread 25 of the outflow pipe 2. The threaded tube 12 being firmly rotated, the outflow pipe 2 is pressed with considerable force against the housing part 1. Very high forces can be achieved as a result of the pitch difference. Alternatively, the thread with the large pitch may also be arranged on the molding side and that with the smaller pitch on the outflow-pipe side.

Figure 7:
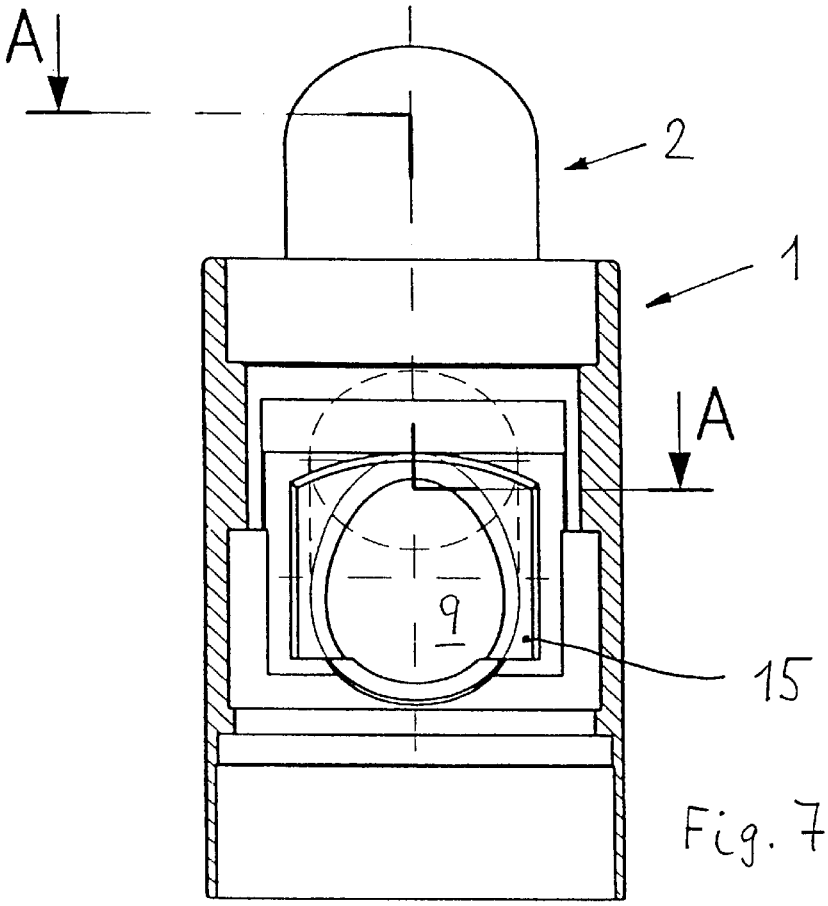
FIG. 7 shows a longitudinal section through a fitting part designed as a housing part.
Figure 8:
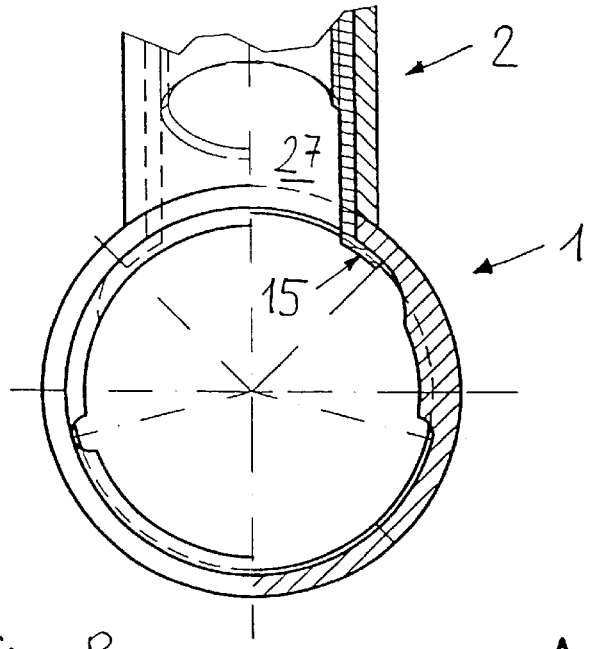
FIG. 8 shows a section along the line A—A in FIG. 7.

One possible version of the flange 15 of the fastening part 11 in the region of the orifice 9 of the fitting part 1 is illustrated, enlarged, in FIGS. 7 and 8, in which the duct-like communication 27 between the two fitting parts 1 and 2 is also indicated.

Figure 9:
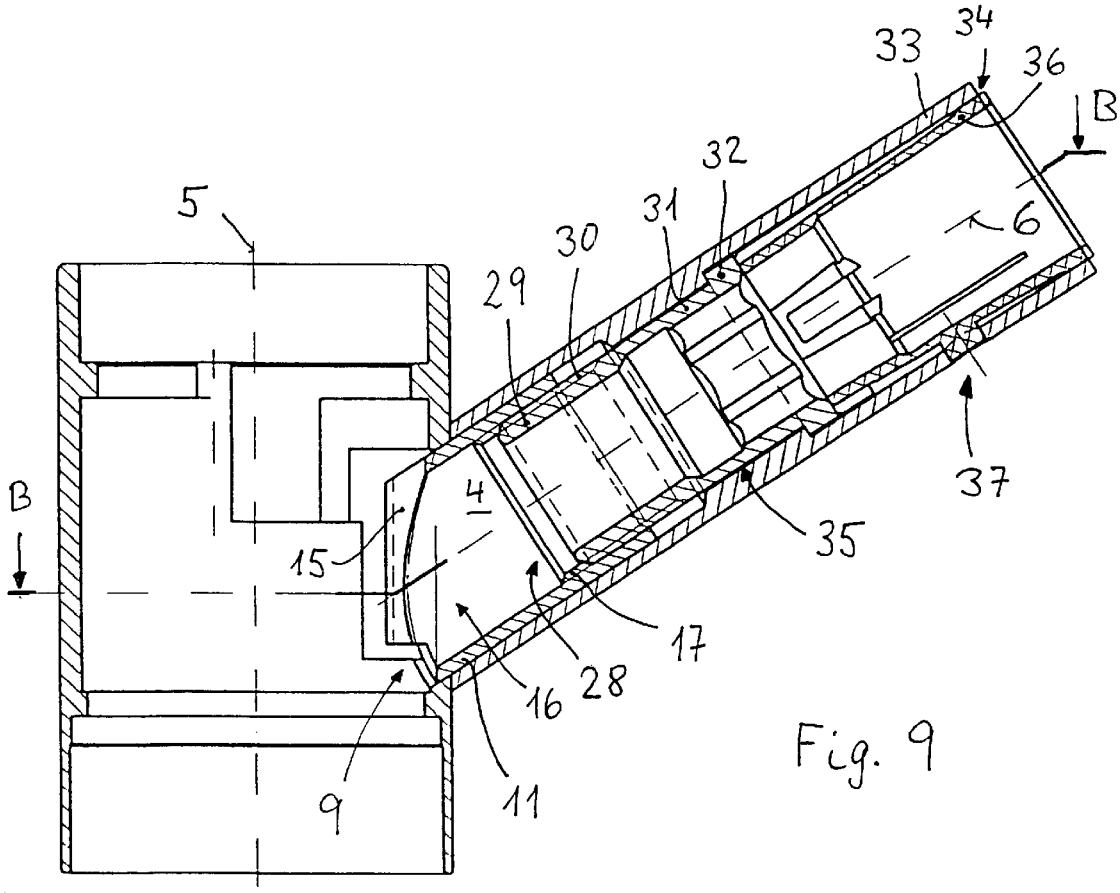
FIG. 9 shows a longitudinal section through the two fitting parts connected by means of a further embodiment of the fastening device.
Figure 10:
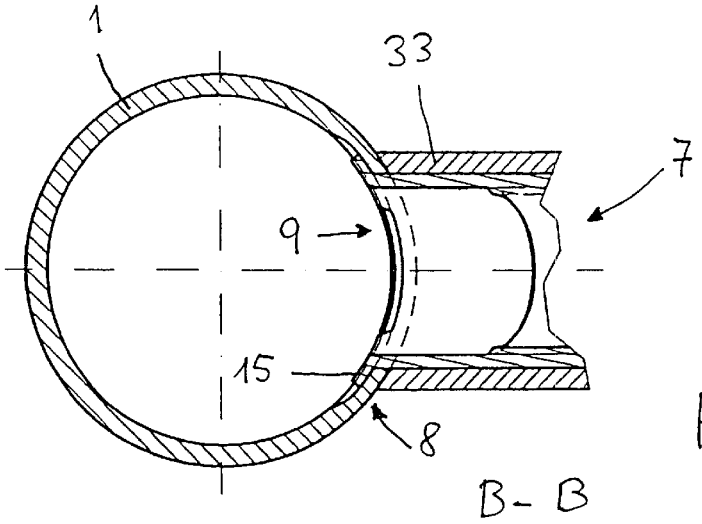
FIG. 10 shows a section along the line B—B in FIG. 9.

The version according to FIGS. 9 and 10 comprises a fastening part 11 of the same type as, or of a similar type to the version according to FIG. 2. However, according to this version, the threaded tube 28 has a lower portion 29 with an external thread 30 and a smooth upper portion 31 which terminates in an annular projecting flange 32. In this case, the fitting part is designed in the form of an outflow pipe piece 33 and has an axial cavity or passage 4 with a mouth 34. In this case, too, the fitting parts 1 and 33 have in each case axial longitudinal axes 5 and 6, which are located in one and the same plane, and are connected to one another in close contact by means of the fastening device 7. The outflow pipe piece 33 is held clamped as a result of the action of the external thread 30, co-operating with the internal thread on the fastening part 11, of the threaded tube 28 and of its shoulder 32 which presses against an annular step 35 of the outflow pipe piece 33 as a countershoulder.

The fastening device according to FIGS. 9 and 10 functions as follows:

The preferably pressed fastening part 11, which is also referred to as a molding, is inserted from inside into the orifice 9 of the fitting or housing part 1. By virtue of its shape, the molding 11 then comes to bear fixedly in terms of rotation against the housing part 1 at the angle W. The threaded tube 28 is introduced through the orifice 34 of the outflow pipe piece 33 up to abutment at the step 35. The outflow pipe piece 33 is thereafter added over the fastening part 11 in such a way that the latter comes to bear on the housing part 1 in the correct rotary position with respect to the angle W. The threaded tube 28 is then rotated from the housing part 1 or preferably from the side facing away from the housing part 1 by means of an, if appropriate, flexible shaft, until the outflow pipe piece 33 presses against the housing part 1. The threaded tube 28 thus, on the one hand, comes into engagement with the internal thread 17 of the fastening part 11 and, on the other hand, presses with the shoulder 32 against the step 35 of the outflow pipe piece 33. The selected dimensions are such that, in this position, the end region of the fitting part 33 is in contact with the outer surface 8 of the fitting part 1. A further tubular element 36 can subsequently be inserted into the outflow pipe piece 33 and be fastened by means of a snap fastening 37.

In the examples described, the fastening device 11, 12 or 11, 28 is intended to be installed in a lateral fitting part 2, 33 which, in one end region, has a cavity 4 in which there is, preferably peripherally, an inner fastening means 25 and 35 for the fastening device 7. However, other fastening means could also be used.

By means of the fastening device according to the invention, the connection between the fitting parts 1 and 2 or 1 and 33 is not readily releasable, so that a complete unit, as a replacement for a corresponding one-piece structure, is thereby obtained. The two unreleasably connected parts prove particularly advantageous in terms of their surface treatment. This is because a corresponding one-piece structure would be relatively difficult to clean, grind, polish, chromium-plate, lacquer, etc., particularly in the region of the sharp-edged contact line of the two fitting parts. Since, according to the invention, the fitting parts 1, 2 or the outflow pipe 33 are originally separate, such surface treatments can be carried out satisfactorily.

It is unimportant for the present invention whether the cross sections of the fitted parts 1 and 2 are circular or have another, for example elliptic shape. The cylindrical wall 8 is therefore to be understood, in general, as the outer wall of the fitting part 1.

In all these variants, the passage or the orifice through all the elements may be such that a flexible or more or less rigid small tube serving as a water conduit can be led not only through the cavities of the housing part 1 and of the outflow pipe 2 or 33, but also through the fastening device 7. In particular, a flexible hose of a pull-out shower can be led through.

What is claimed is:

1. A fastening device for fitting parts which are designed to allow communication with a lateral fitting part via an orifice (9) on an outer wall (8) of a wide fitting part (1), wherein, in order to fasten the lateral fitting part (2; 33) on an end face to the outer wall (8) of the wide fitting part (1) at a predetermined angle, the fastening device (11, 12; 11, 28) is intended to be installed in the lateral fitting part (2; 33) which, in one end region, has a cavity (4) in which there is an inner fastening means (25; 35) for the fastening device (7), the fastening device (7) comprises a fastening part (11) and a threaded tube (12; 28) capable of being screwed into the fastening part (11), the fastening part (11) has mounting means (15) in order to be mounted on the orifice (9) of the wide fitting part (1), a first end (10) of the fastening part (11) has a zone (16), having a shape which is matched to the outer wall (8) of the fitting part (1) according to the predetermined angle, the threaded tube (12; 28) has an outer fastening means (23; 32) which is designed to co-operate with the inner fastening means (25; 35) of the lateral fitting part (2; 33), and the threaded tube (12) has two portions (20, 21), each with an external thread (22, 23), the external threads having different pitches and being intended to co-operate with corresponding internal threads on the fastening part (11) and fitting part (2).

2. The fastening device as claimed in claim 1, wherein the fastening part (11) is of tubular design, with a flange orifice (14) at which the matched zone (16) has a flange (15) with a rear side of cylindrical and/or curved design such that, after the installation of the fastening part (11) through the orifice (9) of the outer wall (8) of the wide fitting part (1), said zone is supported on an inner side of the outer wall (8) in which the orifice (9) on the outer wall is located.

3. The fastening device as claimed in claim 1, wherein the fastening part (11) has at a second end (13) a region with an internal thread (17) between an annular end face (18) and an inner shoulder (19).

4. The fastening device as claimed in claim 1, wherein the two portions (20, 21) have different diameters from each other, and between the two portions (20, 21) is located a threadless intermediate portion (24), by which the two portions (20, 21) are firmly connected.

5. A fastening device for fitting parts which are designed to allow communication with a lateral fitting part via an orifice (9) on an outer wall (8) of a wide fitting part (1), wherein in order to fasten the lateral fitting part (2; 33) on an end face to the outer wall (8) of the wide fitting part (1) at a predetermined angle, the fastening device (11, 12; 11, 28) is intended to be installed in the lateral fitting part (2; 33) which, in one end region, has a cavity (4) in which there is an inner fastening means (25; 35) for the fastening device (7), the fastening device (7) comprises a fastening part (11) and a threaded tube (12; 28) capable of being screwed into the fastening part (11), the fastening part (11) has mounting means (15) in order to be mounted on the orifice (9) of the wide fitting part (1), a first end (10) of the fastening part (11) has a zone (16), having a shape which is matched to the outer wall (8) of the fitting part (1) according to the predetermined angle, the threaded tube (12; 28) has an outer fastening means (23; 32) which is designed to co-operate with the inner fastening means (25; 35) of the lateral fitting part (2; 33) and the threaded tube (28) has a first portion (29) with an external thread (30) and second portion (31) with an annular flange (32) which constitutes the outer fastening means of threaded tube (28).

6. A fitting with two fitting parts, communication with a lateral fitting part (2) being ensured through an orifice (9) of an outer wall (8) of a wide fitting part (1), wherein there is a fastening device (7) which fastens the lateral fitting part (2; 33) on the end face to the outer wall (8) of the wide fitting part (1) at a predetermined angle, the lateral fitting part (2; 33) has, in one end region, a cavity (4) in which there is an inner fastening means (25; 35) for the fastening device (7), the fastening device (7) comprises a fastening part (11) and a threaded tube (12; 28) capable of being screwed into the fastening part (11), the shape of a zone (16) at one end of the fastening part (11) is matched to the outer surface of the outer wall (8) of the fitting part (1) according to the predetermined angle, the fastening part (11) has mounting means (15), via which the fastening part (11) is mounted on the orifice (9) of the wide fitting part (1), the threaded tube (12; 28) has an outer fastening means (23; 32) which is designed to cooperate with the inner fastening means (25; 35) of the lateral fitting part (2) and the threaded tube (12) has two portions (20, 21), each with an external thread (22, 23), the external threads having different pitches and being intended to cooperate with corresponding internal threads on the fastening part (11) and fitting part (2).

7. The fitting as claimed in claim 6, wherein the lateral fitting part is designed in the form of an outflow pipe piece (33) and has an axial passage (4) with a tubular mouth (34).

8. The fitting as claimed in claim 7, wherein a tubular element (36) is inserted into the outflow pipe piece (33) and is fastened by means of a snap fastening (37).

9. The fitting as claimed in claim 6, wherein the passage (4) of the fastening device (7) is such that a small water conduit tube, preferably a flexible hose of a pull-out shower, can be led through said passage and through cavities of the fitting parts (1, 2; 33).

* * * * *